US010378233B2

(12) United States Patent
Shirley-Smith

(10) Patent No.: US 10,378,233 B2
(45) Date of Patent: Aug. 13, 2019

(54) WATER CRAFT, GROUND TENT, TREE TENT COMBINATION

(71) Applicant: TENTSILE LTD, London (GB)

(72) Inventor: Alex Shirley-Smith, London (GB)

(73) Assignee: TENTSILE LTD, London (GB)

( * ) Notice: Subject to any disclaimer, the term of this patent is extended or adjusted under 35 U.S.C. 154(b) by 32 days.

(21) Appl. No.: 15/790,341

(22) Filed: Oct. 23, 2017

(65) Prior Publication Data

US 2019/0119943 A1 Apr. 25, 2019

(51) Int. Cl.

| | |
|---|---|
| ***E04H 15/04*** | (2006.01) |
| ***B63B 17/02*** | (2006.01) |
| ***E04H 15/00*** | (2006.01) |
| ***E04H 15/20*** | (2006.01) |
| ***B63B 35/58*** | (2006.01) |
| ***B63B 35/73*** | (2006.01) |
| ***E04H 15/30*** | (2006.01) |
| ***E04H 15/56*** | (2006.01) |
| *E04H 15/42* | (2006.01) |
| *E04H 15/44* | (2006.01) |
| *E04H 15/54* | (2006.01) |

(52) U.S. Cl.

CPC ..... *E04H 15/008* (2013.01); *B63B 35/58* (2013.01); *B63B 35/73* (2013.01); *E04H 15/04* (2013.01); *E04H 15/20* (2013.01); *E04H 15/30* (2013.01); *E04H 15/56* (2013.01); *E04H 15/42* (2013.01); *E04H 15/44* (2013.01); *E04H 15/54* (2013.01); *E04H 2015/202* (2013.01); *E04H 2015/208* (2013.01)

(58) Field of Classification Search

USPC ..... 135/90, 95, 96, 137, 156, 116, 135/120.3–120.4; 5/121–122, 128, 5/418–420, 656, 668; 114/343, 345, 361; 4/498, 499; 441/38–40, 129

See application file for complete search history.

(56) References Cited

U.S. PATENT DOCUMENTS

| | | | | |
|---|---|---|---|---|
| 4,766,918 | A * | 8/1988 | Odekirk | E04H 15/02 114/345 |
| 4,799,910 | A * | 1/1989 | Kellough | A47C 15/006 441/130 |
| 5,560,056 | A * | 10/1996 | Tai | A45F 3/22 297/118 |
| 6,353,946 | B1 * | 3/2002 | Steiner | A45B 3/00 5/120 |
| 6,881,114 | B2 * | 4/2005 | Zheng | B63B 7/08 441/129 |

(Continued)

*Primary Examiner* — Winnie Yip

(74) *Attorney, Agent, or Firm* — Michael J. Feigin, Esq.; Feigin and Fridman LLC

(57) ABSTRACT

A tent is designed for use in the air, connected at its vertices to trees or the like. The tent is further designed with enough support from an independent support structure to create a shelter there-in while in the air or on the ground. Further, the tent is built atop a floating mat or base. In order to provide enough strength to the base that it can be used to float the entire tent or hold the tent airborne, straps extend from each vertex of the mat through a central portal and connect back to themselves. From these straps, loops are further created to attach the tent, by way of the loops, to trees while the entirety of the mat is buoyant enough to hold the tent and people there-in afloat.

19 Claims, 8 Drawing Sheets

(56) References Cited

U.S. PATENT DOCUMENTS

| | | | | |
|---|---|---|---|---|
| D530,772 | S * | 10/2006 | Peterson | D21/809 |
| 7,314,399 | B2 * | 1/2008 | Turner | A47C 15/006 441/129 |
| 8,375,968 | B2 * | 2/2013 | Whybrew | B63G 13/02 114/345 |
| 8,393,288 | B1 * | 3/2013 | Ramsey | B63B 7/085 114/345 |
| D711,999 | S * | 8/2014 | Shirley-Smith | D21/837 |
| D755,322 | S * | 5/2016 | Shirley-Smith | D21/839 |
| 2005/0188460 | A1 * | 9/2005 | O'Brien | A45F 3/22 5/121 |
| 2018/0195308 | A1 * | 7/2018 | Olivo | E04H 15/20 |

* cited by examiner

WATER CRAFT, GROUND TENT, TREE TENT COMBINATION

FIELD OF THE DISCLOSED TECHNOLOGY

The disclosed technology relates generally to water craft and tents and, more specifically, to a combination water craft, ground tent, and suspended in air tent.

BACKGROUND OF THE DISCLOSED TECHNOLOGY

Tree tents, trees which remain suspended in the air, are known in the art. For example, U.S. Design Pat. No. D721,153 to the same inventor is such a tent designed to be suspended from poles or trees at each corner. Such tends are typically designed with tension from each corner in mind. Compared to a traditional ground tent where forces are distributed downwards over the entirety of the walls of the tent, a tree tent is often supported by its corners alone. In this manner, one can, for example, attach the tent to three trees by rope and enjoy.

Such tents, however, tend to be specifically for being above ground. There exists a desire and largely unsolved need to provide a tent that can be used above ground, but can equally well be used on the ground itself. Tends such as those disclosed in U.S. Pat. No. 4,251,959 to Hsu and U.S. Pat. No. 4,295,302 to Liu are designed for the water or land, but cannot be said to be suspended from trees without first building an entire platform or ground for the tent to reside there-on. This is far from ideal.

What is needed is a way to build a tent which is strong enough for use in a tree, on the ground, and perhaps even in water so that a single tent can be used for all occurrences during both recreational camping and emergencies including floods, wild animals, and zombie attacks.

These and other limitations of the prior art are solved by embodiments described in the present disclosure.

SUMMARY OF THE DISCLOSED TECHNOLOGY

A tent of the disclosed technology is actually a water vehicle (raft) which can float, a land tent (a shelter whose base rests on the ground), and an above-ground dwelling (held to trees, poles, or other vertically extending items capable of supporting the dwelling by its sides or corners). In order to accomplish this, the tent, in some embodiments, is triangular. There is a triangular flotation device which can have a portal formed therethrough. The portal in one embodiment is triangular, and in this or another embodiment, is centrally located within the flotation device. The portal extends through from the top side to the bottom side of the flotation device and the interior space of the portal, or at least the edges thereof might be filled in with a solid object (a rigid triangular-shaped insert, for example) and/or re-enforced with a solid object. This portal allows a strap to extend around, for example, each vertex of the triangular flotation device and around each vertex of the triangular portal (the remaining space or edges of the portal then filled in, in some embodiments). In other embodiments, however, the straps may extend in a different configuration, for instance passing around the mid-point of each edge of the flotation device. There is thus in a triangular flotation device three re-enforcing straps, one extending around each vertex of the portal and larger flotation device. The flotation device can be made of plastic, inflated with air, and/or if solid and/or hollow construction. This device is then capable of a) floating, b) resting on the ground, and c) being supported at each exterior corner while holding weight there-above.

There-above the flotation device and re-enforcing straps can be one or more rigid poles ("rigid" being defined as adapted to retain or return to their original shape without breaking). Such poles extend, in embodiments of the disclosed technology, from a connector mounted to the flotation device such as mounted to the straps which are sewn to a cover of, and/or the flotation device itself. The connector can be a triple connector (having portals for three poles), the portals being female portals. A rigid skeletal frame is then formed, in embodiments of the disclosed technology, by poles extending between each triple female connector and at least one additional connector spaced apart from the triangular flotation device.

The re-enforcing straps which extend around each vertex of the triangular portal and triangular flotation device can be sewn along an entirety (defined as "at least 90% or at least 98%) of its length to a cover adapted to fit over and touch all or the entirety of the exterior sides of the flotation device and/or the flotation device itself. Each strap can also double back on itself near a vertex (defined as "closer to a vertex than a center point of the device") of each vertex of the triangular flotation device forming a loop. The loop can be positioned exterior to the flotation device, such as extending from a vertex of the flotation device.

A portion of each strap, in embodiments of the disclosed technology, is a triple layer meaning that the strap, which is continuous from end to end, folds over and is sewn to itself in two places such that three layers of the strap are one over another. An innermost layer of the triple layer is sewn to the flexible triangular-shaped cover, a middle layer of the triple layer is an end of the respective strap, and the outer layer is continuous and adjacent to a portion of the strap which is also sewn (where the strap is no longer triple layer) to the flotation device or a cover of the flotation device.

The triple female connector blocks an inner tent cover from moving toward a nearest vertex of each vertex of the triangular flotation device. The nearest vertex is the vertex closest to a respective triple female connector and edge of the inner tent cover being blocked. The inner tent cover is a cover which, in embodiments of the disclosed technology, is directly over and/or under the skeletal frame and the inner most layer of a shelter formed. A shelter is defined as layer between and/or defining an inner space adapted to hold a human being and the outside world.

The triple female connector has three poles extending out therefrom in embodiments of the disclosed technology, such as a curvilinear center pole which curves at an acute angle until reaching exactly above a center of the inner triangular portal and meeting with other center poles. Outer or side poles can further extend from the triple female connector and attach to each other at vertices above a plane defined by the flotation device. The "bottom" side of the tent is defined as one in which is designed to be adjacent to the gravitational bottom of the device and the "top" side of the tent is one which is generally designed to point away from a direction of gravity. For example, the top side is a side with the skeletal structure and shelter.

Out of each of the triple female connector outer portals are two angled poles which extend at equal and opposite angles on either side of the center pole and join with a corresponding angled pole extending from a different of triple female connectors, in embodiments of the disclosed technology. A six port female connector holds each center pole together directly above the triangular portal in some embodiments.

A top of the triangular flotation device is a side adjacent to the triple female connector and a bottom of the triangular flotation device is a side opposite the top side in embodiments of the disclosed technology. The inner tent cover wraps around a bottom side of the triangular flotation device and is connected to the skeletal frame forming an enclosed space (shelter) between the triangular flotation device and the inner tent cover with at least one opening there-in in embodiments of the disclosed technology. A rain canopy (a canopy which keeps the rain from directly entering into the shelter) exterior to the inner tent cover and the skeletal frame is attached to a strap extending outward from a loop formed at a vertex of the triangular flotation device in some embodiments of the disclosed technology.

This tent is thus adapted to be held above ground (by attaching each of the loops to a pole/tree which extends upward from the ground), to float on water (by way of placing the triangular floating device in water), and to rest on the ground. The skeletal frame is free-standing on the triangular flotation device irrespective of the tent being held about the ground, placed on the ground, or floating in water.

Described another way, a land, water, and air tent of the disclosed technology has a flotation device surrounded by a cover, re-enforcing straps extending around each vertex of the flotation device and the cover, and an inner tent extending around a bottom of the flotation device and upwards from the flotation device supported by rigid poles. A connector in this embodiment is attached to the re-enforcing straps out of which the rigid poles emanate and extend away from said flotation device. Further connectors hold the inner tent to the rigid poles. A rain cover can be frictionally held against the rigid poles and held taut at each end of the rain cover. The re-enforcing straps, in some embodiments, double back on themselves at their respective ends forming a triple layer of material and a loop, the loop of each re-enforcing strap being at a corner of the flotation device.

A portal, in embodiments of the disclosed technology, extends through a center of the flotation device (creating a space from top to bottom through which liquid and solid items can pass) through which each re-enforcing strap of the re-enforcing straps extend there-through. The portal and the flotation device have a geometrically identical shape in embodiments of the disclosed technology, such as a triangle shape (meaning that there are two two-dimensional triangular planes defined by the exterior sides of each of the portal and flotation device, the two-dimensional triangular planes connected in the third dimension). The rigid poles are held in place with respect to the flotation device by a triple female connector associated with (nearest to one of) each vertex of the triangle. The triple female connector is between the inner tent and a vertex of the flotation device in embodiments of the disclosed technology.

Three poles of the rigid poles extend from each of the triple female connectors with two poles of the three poles joining corresponding poles extending from a different one of the triple female connectors and one pole of the three poles extending directly above the portal of the flotation device in embodiments of the disclosed technology.

Any device or step to a method described in this disclosure can comprise, or consist of, that which it is a part of, or the parts which make up the device or step. The term "and/or" is inclusive of the items which it joins linguistically, and each item by itself.

DETAILED DESCRIPTION OF EMBODIMENTS OF THE DISCLOSED TECHNOLOGY

A tent is designed for use in the air, connected at its vertices to trees or the like. The tent is further designed with enough support from an independent support structure to create a shelter there-in while in the air or on the ground. Further, the tent is built atop a floating mat or base. In order to provide enough strength to the base that it can be used to float the entire tent or hold the tent airborne, straps extend from each vertex of the mat through a central portal and connect back to themselves. From these straps, loops are further created to attach the tent, by way of the loops, to trees while the entirety of the mat is buoyant enough to hold the tent and people there-in afloat.

Embodiments of the disclosed technology will become more clear in view of the following description of the drawings.

Figure 1:
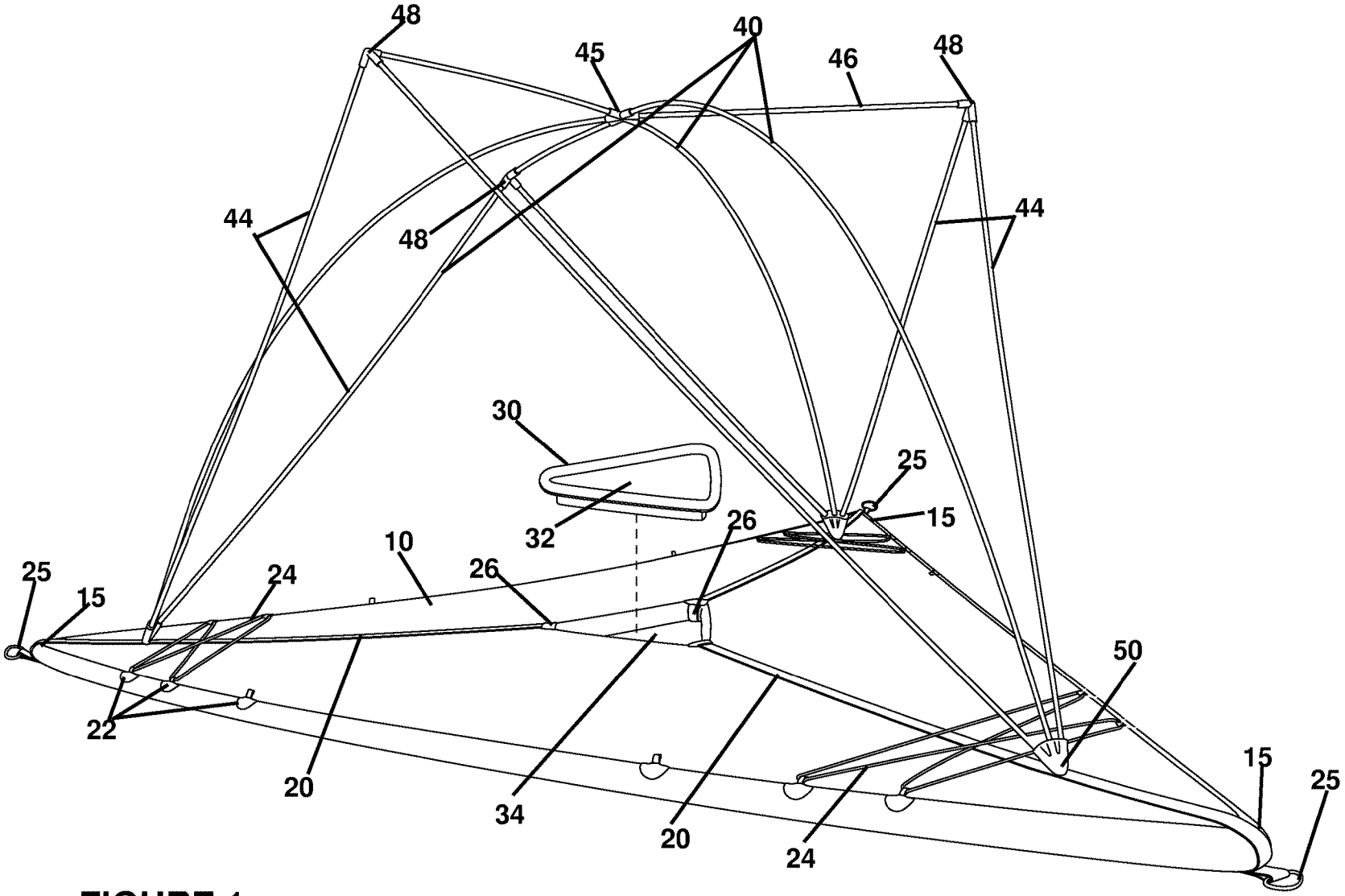
FIG. 1 shows a perspective view of a flotation device (base) of the land, water, and air tent with skeletal tent frame of an embodiment of the disclosed technology.

FIG. 1 shows a perspective view of a flotation device (base) of the land, water, and air tent with skeletal tent frame of an embodiment of the disclosed technology. The flotation device 10 can be hollow or solid, made of plastic, a polymer, or other rigid material which retains or returns to its shape after forces act against the flotation device during use as a tent or raft. Inside the flotation device can be air, another gas, and/or solid material. In one embodiment, the flotation device is made of hard and non-pliable (without the use of tools) plastic, is hollow, and floats. The numeral 10 can actually refer to a cover on the flotation device 11 (see FIG. 6), the cover wrapping snuggly around all sides of the flotation device such that the flotation device 11 is surrounded by the cover in its entirety.

The flotation device 10 (referred to as device 10 for convenience as the cover 10 forms the same shape as the flotation device in embodiments of the disclosed technology) can be triangular/have a triangular cross-section especially on the top and bottom sides, which are then joined together by additional triangular cross-sections. In the center of each cross section can be a portal 34 which is of a similar geometric shape, e.g. a triangle or substantially a triangle. A re-enforcing strap or straps 20 then extends, in embodiments of the disclosed technology, around the exterior side of the flotation device 10 between each corner/vertex 15 and the portal 34, on both the top and bottom sides of the flotation device 10. Thus, each strap 20 extends through the portal 34 at one of the edges/vertexes 26 of the portal, over the top side and bottom side of the flotation device 10 and around a corner/vertex of the flotation device.

Still discussing FIG. 1, note that various connector rings or latches 22 can be used to attach rope 24 laterally across the top side of the flotation device to add strength and stability to the craft. Further, to add stability and strength and rigid and non-bendable (without the aid of tools) insert or triangular insert 30 can be placed within the portal 34. The straps 20 then pass between the insert 30 and flotation device 10. Within the insert 30 defines a space 32 which can be hollow or solid depending on the embodiment of the disclosed technology. When hollow, one can, for example, fish through this hole when using the device as a raft. When solid, this provides an extra barrier against water entering the craft from below.

Now referring to the skeletal structure which supports the tent, e.g. the tent frame, the tent frame emanates from triple female connectors 50. Each of these is, in turn, connected to one of the straps 20. In embodiments of the disclosed technology, each triple female connector 50 has three female ports of equal size, each of which extend in straight paths. However, the center of the portals points towards an (imaginary) vertical center plane equidistant to each vertex 15 of the flotation device 10. The outer portals point outwards at an acute angle to the center portal. The center portal then has, in embodiments of the disclosed technology, a curvilinear pole 40 which extends outwards therefrom to directly above the center of the portal 34 of the flotation device 10. There are three such center curvilinear poles 40 which join at a top and center connector 45 situated in the (imaginary) vertical line directly above the center of the flotation device's portal 34. This connector 45 at the top of the center of the flotation device 10 has six ports in embodiments of the disclosed technology. Three of the ports are used by the curvilinear poles 40 which are at 120 degree angles to one another in embodiments of the disclosed technology.

The outer ports of the triple female connector 50 have there-within, in embodiments of the disclosed technology, rigid and straight (non-curved) poles 44 which join at upper connectors 48 which will form extreme corners of an inner tent (shelter area). From the extreme corners 48 (of which there are three when using a triangular flotation device), lateral and straight poles 46 connect same to the top and center connector 45 for added support. While the above describes one embodiment of the disclosed technology, for the skeleton of the tent, the skilled reader will appreciate that the skeleton may take any other suitable form, and make use of any suitable type and number of poles, and make use of any type and number of connectors, not limited to the kinds of connectors mentioned above.

Figure 2:
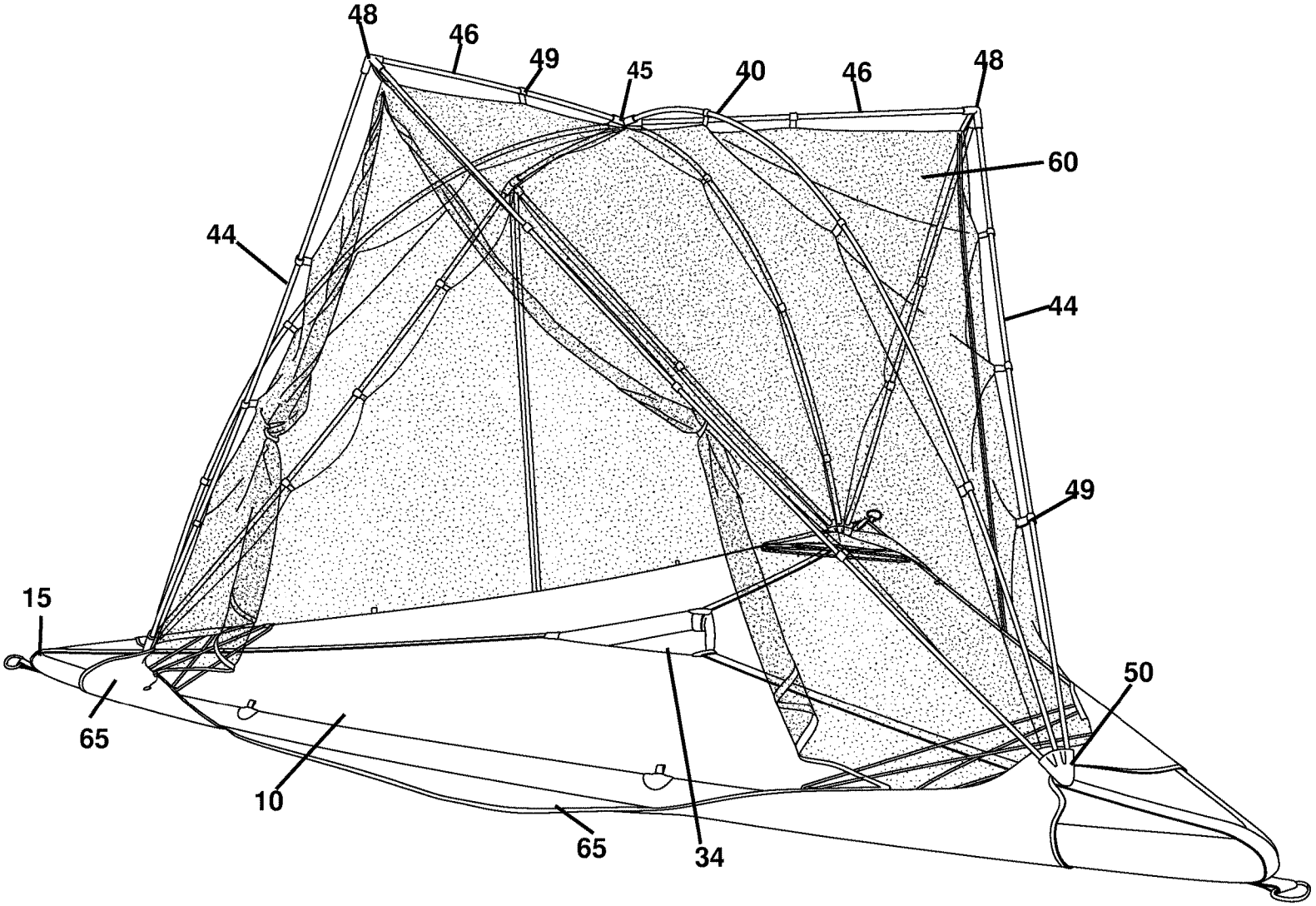
FIG. 2 shows the tent of FIG. 1 with a tent cover attached to the flotation device (base) and skeletal frame in an embodiment of the disclosed technology.

FIG. 2 shows the tent of FIG. 1 with a tent cover attached to the flotation device (base) and skeletal frame in an embodiment of the disclosed technology. The tent cover 60 can be made of flexible material, can be water proof (blocking the passage of water there-through), or porous (having holes less than 0.5 centimeters throughout a majority or entirety thereof). The tent cover 60 can have a lower portion 65 made of a different or the same material (such as a solid and non-porous material whereas the upper section is porous) which passes around the lower side of the flotation device 10. The triple female connector can serve to hold the tent cover 60/65 in place by blocking movement of the tent cover any closer to the vertex 15 than the connector 50, at the point where the connector 50 blocks such movement. When the tent cover 65 extend around the bottom side of the flotation device 10 and the portal 34 of the flotation device is left hollow, the tent cover is unobstructed at most or all of its lateral/top sides and at least some of its bottom side to/within the shelter. In embodiments of the disclosed technology, the flotation device is sufficiently buoyant that, if the tent is placed in water (e.g. still water), with the skeleton, the cover 60 and any further cover (for example as discussed below) in place, the tent will float, with the skeleton and cover above the water level. In some embodiments, the tent will also float in this manner if a person of average size, along with equipment, is supported by the flotation device. For example, the tent may float in this manner if 100 kg (above and beyond the parts of the tent itself) is supported by the flotation device.

Figure 3:
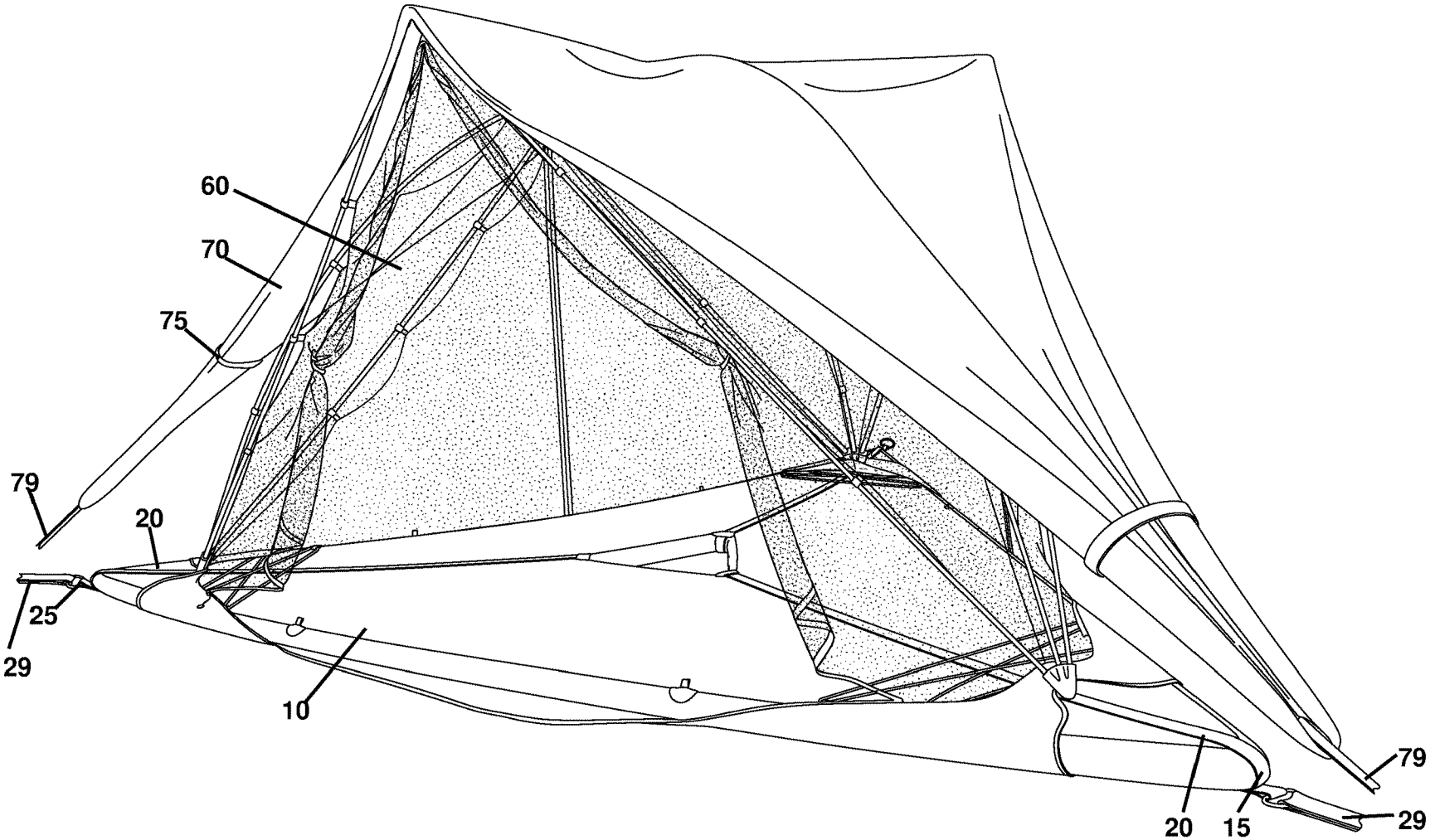
FIG. 3 shows the tent of FIG. 2 with a rain cover frictionally held above the tent cover and at ends thereof in an embodiment of the disclosed technology.

FIG. 3 shows the tent of FIG. 2 with a rain cover frictionally held above the tent cover and at ends thereof in an embodiment of the disclosed technology. The rain cover 70 in embodiments of the disclosed technology is impervious to water, ensuring that the interior space between the top side of the flotation device 10 and the top portion of the tent cover 60 and/or the rain cover 70 remains dry (mostly, entirely, substantially, or fully). The rain cover 70 can be held together at portions by bands 75 which limit how wide the rain cover can expand. Ends of the rain cover, which can be substantially triangular, can lead to straps 79 which can, in turn, be tied to another device such as a respective strap 29 extending from and/or connecting to a strap 20 or connector 25 at the vertex 15 of the flotation device 10. The connector 25 is a loop or comprises a loop within the strap 20 in embodiments of the disclosed technology (see the description of FIG. 5 for more details).

Figure 4:
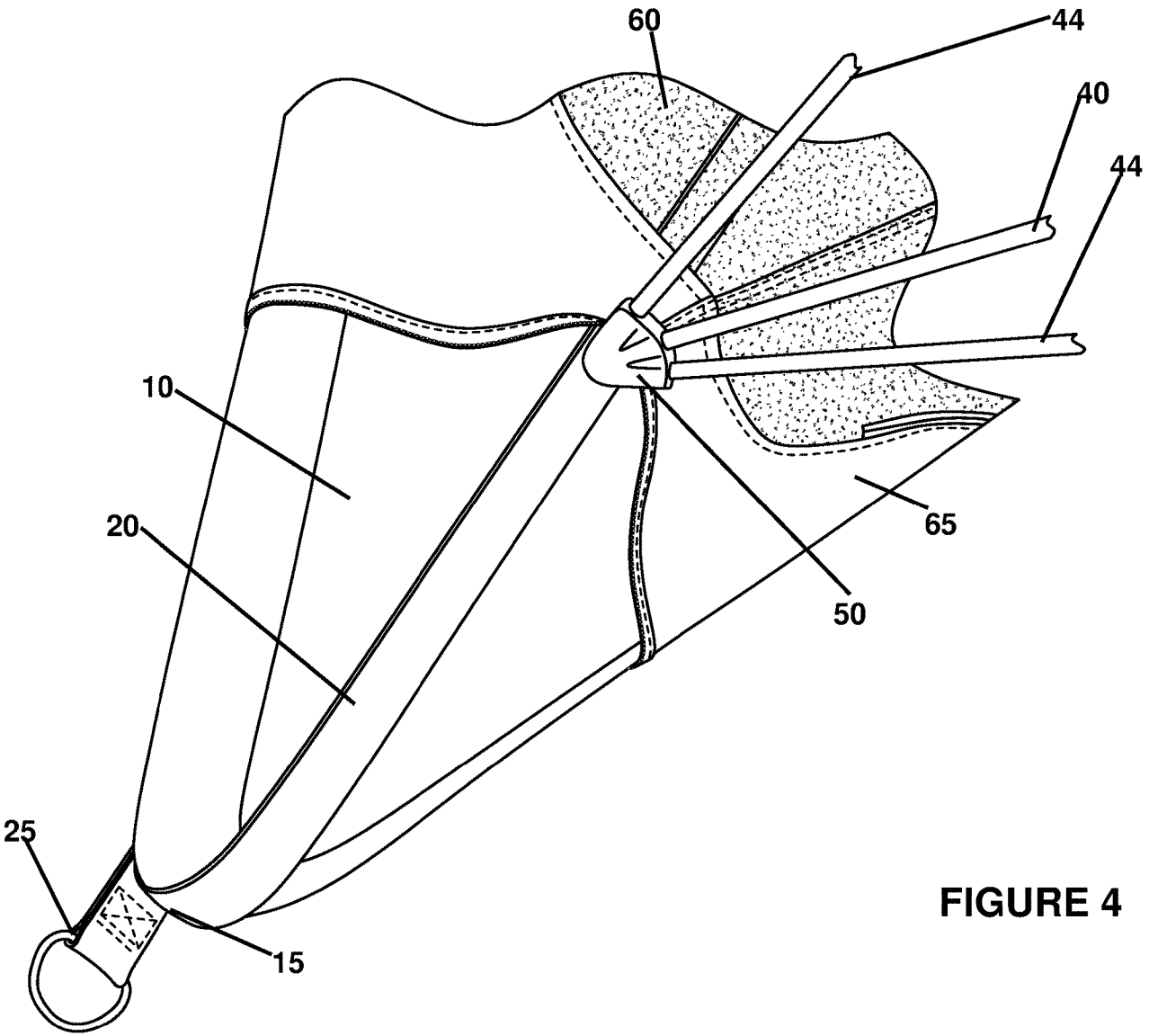
FIG. 4 shows a closeup of a top side of a vertex (corner) of the flotation device of an embodiment of the disclosed technology.

FIG. 4 shows a closeup of a top side of a vertex (corner) of the flotation device of an embodiment of the disclosed technology. Note that the solid part of the tent cover 65 is sewn to the porous part of the tent cover 60. The broken dashed lines denote stitching/sewing used in embodiments of the disclosed technology. The triple female connector 50 is connected to the strap 20, which is, in turn, sewn to a cover 10 of the flotation device. Poles extend out of the three portals of the female connector 50 equi-angled to each other with the center pole 40 extending such that it is in a (single) same plane of as the strap 20, but the poles 44 are in different planes (in three dimensions) than the strap 20. The "same plane" in this case is one which runs perpendicular to the elongated direction of the strap 20 and pole 40 simultaneously. Extending from the vertex 15 is a connector 25 which has a loop formed from the strap 20 and, in the embodiment shown, a rigid metal ring to which another strap can be attached in order to secure the flotation device/mat 10 to a tree when the tent is held off the ground. While FIG. 4 shows one corner of the device, the remaining two corners are substantially or fully identical to this in embodiments of the disclosed technology.

Figure 5:
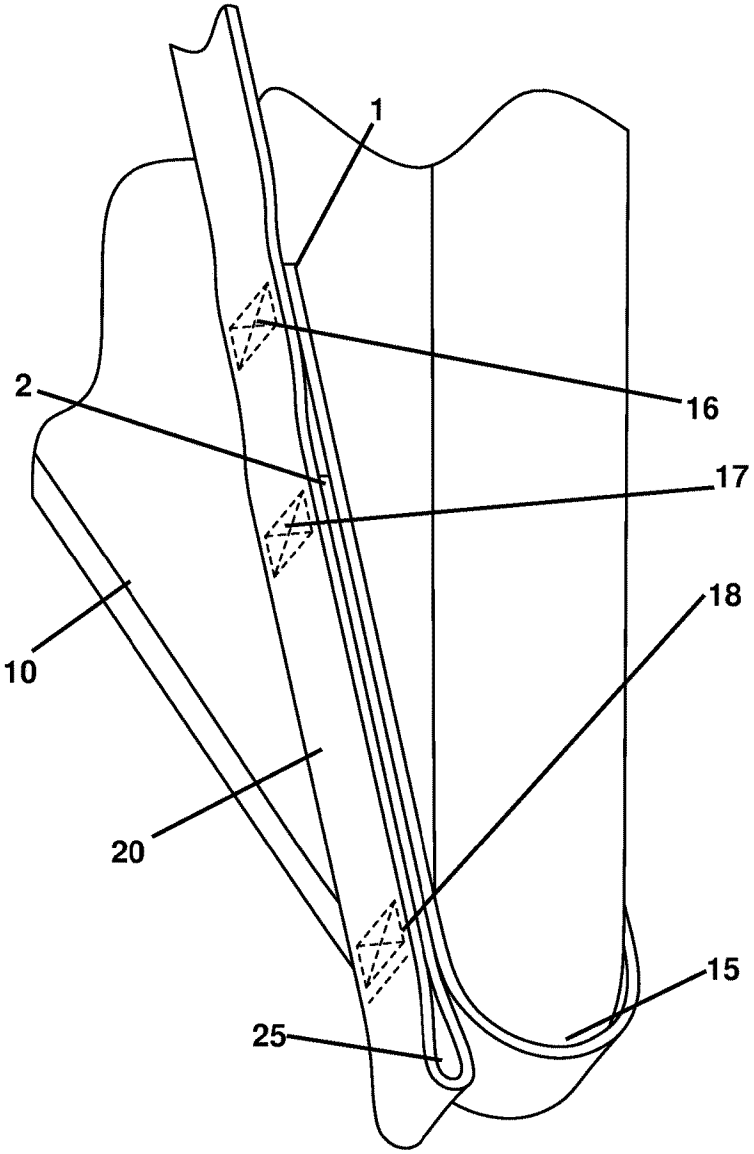
FIG. 5 shows a closeup of a bottom side of a vertex (corner) of the flotation device of an embodiment of the disclosed technology.

FIG. 5 shows a closeup of a bottom side of a vertex (corner) of the flotation device of an embodiment of the disclosed technology. On this bottom side one can see that the strap 20 which extends around the top and bottom side of the flotation device 10 forms a loop 25 adjacent to the vertex 15. "Adjacent to" is defined as "what an ordinary observer would refer to as being at or on the item it is called as such." Now following the strap 20 from its extreme ends and starting at extreme end 1, the strap 20 is sewn to the flotation device cover 10 along its length under reaching the corner/vertex 15 where the strap wraps fully around the flotation device 10 while passing through the portal 34 (see FIG. 1). After passing fully around the flotation device 10 and returning on the bottom side, being sewn to the flotation device all along the way in embodiments of the disclosed technology, the strap is sewn to itself once at the sewing point 16 corresponding to the extreme end 1. Thus, for strength the strap extends all the way around and to itself at 16/1 where it is sewn together, closing a loop. For further strength, it is again sewn to itself, in embodiments of the disclosed technology, at another sewing point 17 which corresponds to the other end 2 of the strap 20. Sewing point 17 is over the end 2 of the strap 20 as well as sews together relatively opposite ends of the strap 20 in triplicate for an extremely strong bond. Further, as a connector is desired on the vertex 15 which is strong enough to hold the entirety of the tent above ground with people and objects there-in, a loop 25 is formed by doubling back the strap on itself and sewing near the loop at sewing point 18 before extending the other extreme end 2 of the strap 20 between other sections of the strap, the extreme end 2 of the strap 20 being held by sewing point 17 as described above. In this manner, the vertices of the triangle are re-enforced and the loop is strong, extending tension from ropes attached there-to to the center of the triangle. It should be understood that where "sewing" and/or "stitching" is described in the description of the disclosed technology, any connection mechanism can be used including stitching two items together, gluing, welding, melting, or a combination thereof.

Figure 6:
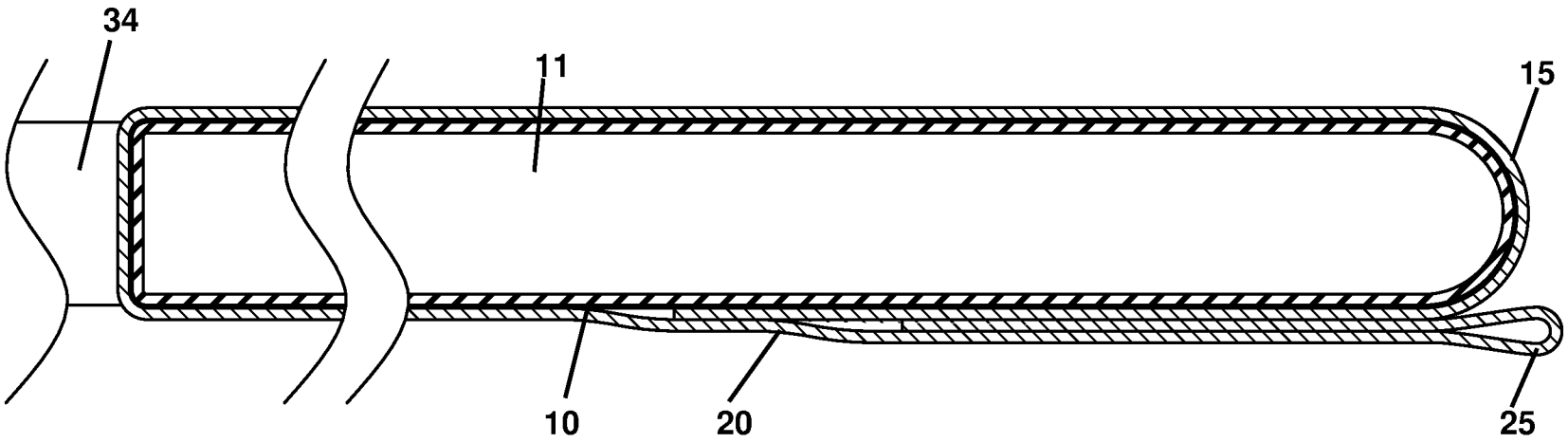
FIG. 6 shows a cutaway elevation view of the flotation device with cover and strap in an embodiment of the disclosed technology.

FIG. 6 shows a cutaway elevation view of the flotation device with cover and strap in an embodiment of the disclosed technology. Here, the flotation device 11 is surrounded by a cover 10 which snugly fits there-to and may be sewn there-around. The cover 10 extends through the portal 34 in embodiments of the disclosed technology, and around this the strap 20 extends there-around as well. When the strap 20 doubles back over itself, a loop 25 is formed to which another strap can be connected when desired.

Figure 7:
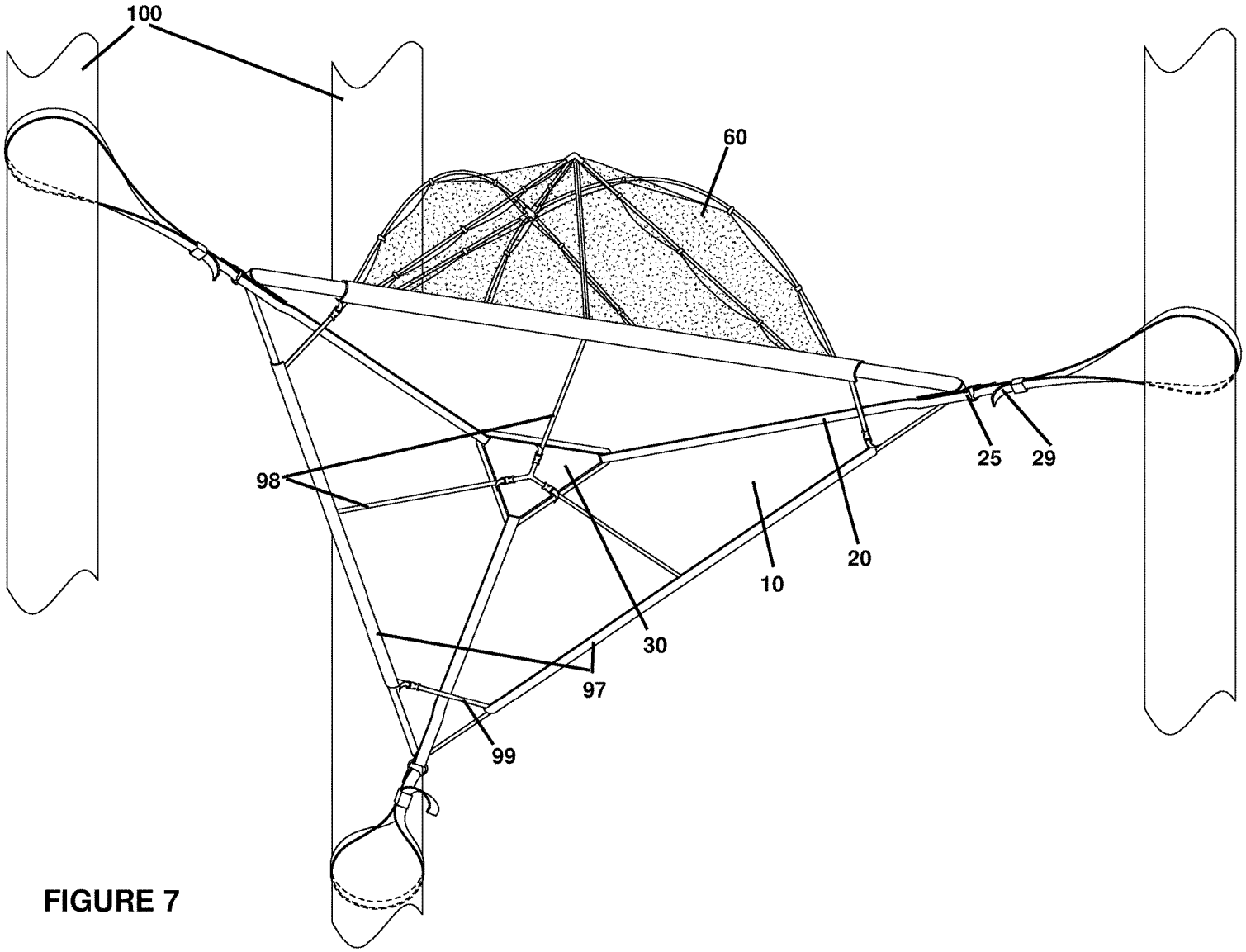
FIG. 7 shows a bottom perspective view of the tent attached to poles in an embodiment of the disclosed technology.

FIG. 7 shows a bottom perspective view of the tent attached to poles in an embodiment of the disclosed technology. The tent is suspended in air in this embodiment meaning that the flotation device 10 which forms the lower portion of the tent is completely separated from the ground and suspended there-from. Further, the flotation device 10 is held and supported substantially at its corners/vertices 15 in embodiments of the disclosed technology. The flotation device 10, which here forms the base of the tent, is held to vertical poles or trees 100 at each corner by rope 29 which can have a loop at the end, or another form of tie or connector. The rope 29 is fastened to a respective loop 25 at each corner of the tent.

Further, the tent can be further secured and strengthened through one or a series of re-enforcements, such as edge covers 97 which cover at least a majority of the edges between the top and bottom sides of the flotation device 10 and/or cover at least a portion of the top and bottom side thereof. These covers 97 can be pulled tightly against the flotation device 10 and towards each other by elastic cables 98 and 99 which pull the covers 97, and thus the flotation device 10, inwards towards itself adding further structural support.

Figure 8:
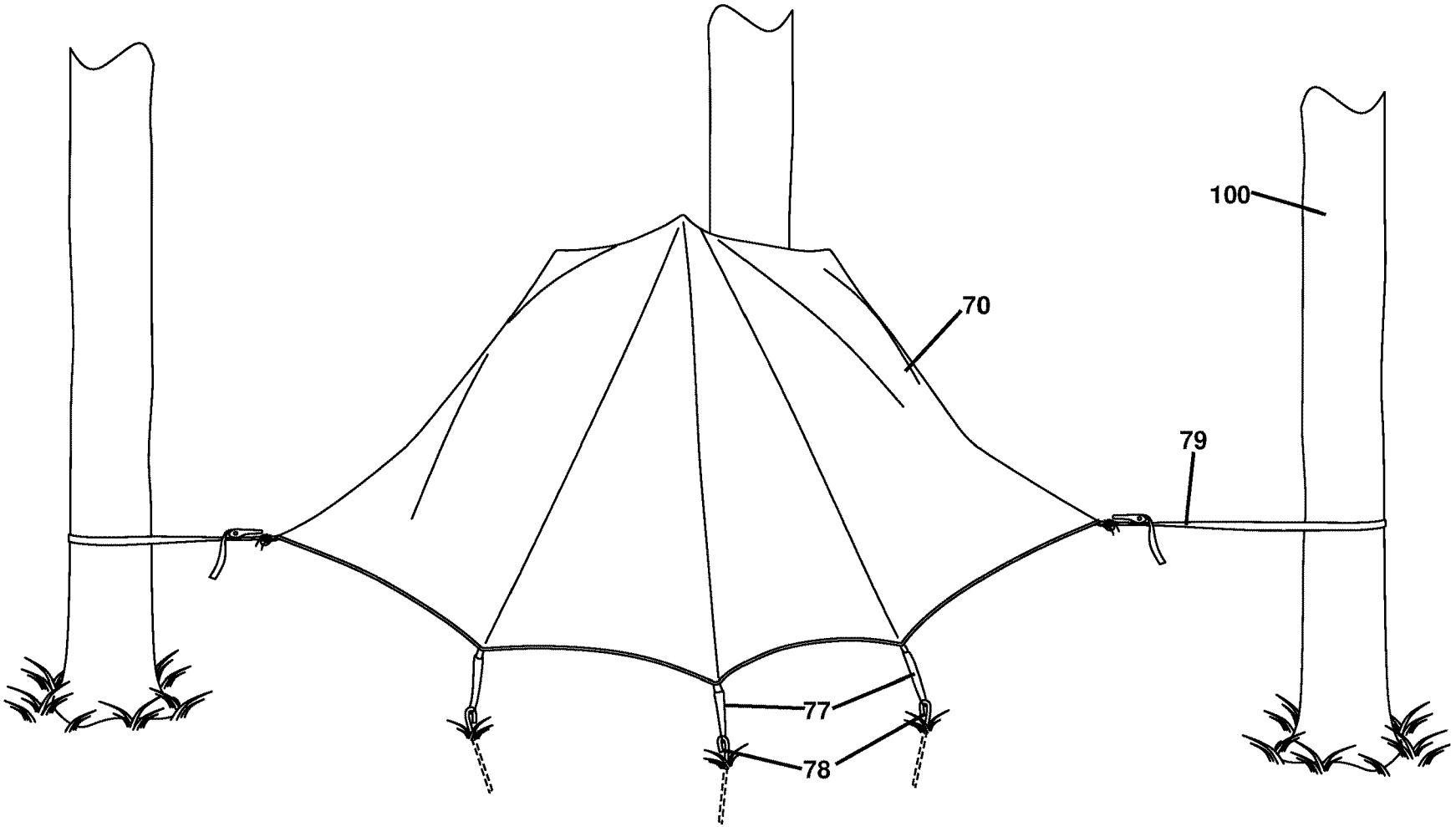
FIG. 8 shows a top perspective view of the tent attached to poles in an embodiment of the disclosed technology.

FIG. 8 shows a top perspective view of the tent attached to poles in an embodiment of the disclosed technology. The tent cover 70 is shown fully expanded in this figure, covering the tent there-below, including a cover over the skeletal framework, shelter, netting, and base in embodiments of the disclosed technology. "Cover" for purposes of this disclosure is defined as "hiding from view when viewed from above, looking downwards" and a netting with holes is considered to be "covering" another object when if the holes of the netting were filled in, an object under the netting would be hidden from view.

This tent cover 70 is attached to trees or other vertical poles or objects 100 by connectors 79 extending from a same number of vertices as the flotation device 10 has (e.g. 3, as shown) in embodiments of the disclosed technology. The connectors 79 can be decreased in length after being attached between the pole 100 and tent cover 70 to increase tension on the line 79. Further, tie-downs 77 can be used to attach the tent cover 70 to the ground via stakes 78 or other fastening devices.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A land, water, and air tent, comprising:

a triangular flotation device with a triangular portal centrally located there-within;

a strap extending around each vertex of said triangular flotation device and around each vertex of said triangular portal;

a triple female connector mounted to each said strap;

a skeletal frame formed by poles extending between each triple female connector and at least one additional connector spaced apart from triangular flotation device.

2. The tent of claim 1, further comprising a rigid triangular insert frictionally held between each side of said triangular portal and each said strap.

3. The tent of claim 1, further comprising a flexible triangular-shaped cover, wherein each said strap is sewn along an entirety of its length to an exterior side of the flexible triangular-shaped cover where said strap covers over a portion of said triangular flotation device.

4. The tent of claim 3, wherein each said strap doubles back on itself near a vertex of each said vertex of said triangular flotation device forming a loop; and a portion of each said strap is a triple layer, an innermost layer of said triple layer sewn to said flexible triangular-shaped cover, a middle layer of said triple layer comprising an end of said strap.

5. The tent of claim 1, further comprising an inner tent cover, wherein said triple female connector blocks said inner tent cover from moving toward a nearest vertex of each vertex of said triangular flotation device.

6. The tent of claim 5, wherein out of each said triple female connector a center pole of said poles extends curvilinearly above a plane defined by a strap of said straps.

7. The tent of claim 6, wherein out of each said triple female connector two angled poles of said poles extend at equal and opposite angles on either side of said center pole and join with a corresponding angled pole extending from a different said triple female connector.

8. The tent of claim 7, wherein said at least one additional connector is a six port female connector which holds each center pole together directly above said triangular portal.

9. The tent of claim 5, wherein a top of said triangular flotation device is a side adjacent to said triple female connector and a bottom of said triangular flotation device is a side opposite the top side; and said inner tent cover wraps around said bottom side of said triangular flotation device and is connected to said skeletal frame forming an enclosed space between said triangular flotation device and said inner tent cover with at least one opening there-in.

10. The tent of claim 9, further comprising a rain canopy exterior to said inner tent cover;

and wherein said skeletal frame is attached to the strap extending outward from a loop formed at a vertex of said triangular flotation device.

11. The tent of claim 9, wherein the tent is adapted for being held above ground by attaching said loop to a pole which extends upward from the ground, said tent further being adapted to float on water by way of placing said triangular floating device in water, wherein said skeletal frame is free-standing on said triangular flotation device irrespective of said tent being held about said ground or floating in said water.

12. A land, water, and air tent comprising:

a flotation device surrounded by a cover;

re-enforcing straps extending around each vertex of said flotation device and said cover;

an inner tent, which is said cover or a separate tent, extending around a bottom of said flotation device and upwards from said flotation device, supported by rigid poles;

a connector attached to each of said re-enforcing straps, wherein said rigid poles are connected to said connectors and extended away from said flotation device;

further connectors holding said inner tent to said rigid poles;

wherein said re-enforcing straps double back on themselves at their respective ends, forming a triple layer of material and a loop, said loop of each said re-enforcing strap being at a corner of said flotation device.

13. The tent of claim 12, further comprising a rain cover frictionally held against said rigid poles and held taut at each end thereof.

14. The tent of claim 12, further comprising a portal extending through a center of said flotation device through which each re-enforcing strap of said re-enforcing straps extends there-through.

15. The tent of claim 14, wherein said portal and said flotation device have a geometrically identical shape.

16. The tent of claim 15, wherein said geometrically identical shape is a triangle.

17. The tent of claim 16, wherein said connector is a triple female connector, and wherein said rigid poles are held in place with respect to said flotation device by said triple female connector associated with each vertex of said triangle of said flotation device which is one of said further connectors or said connector.

18. The tent of claim 17, wherein each said triple female connector is positioned between said inner tent and a vertex of said flotation device.

19. The tent of claim 18, wherein three poles of said rigid poles extend from each said triple female connector with two poles of said three poles joining corresponding poles extending from a different said triple female connector and one pole of said three poles extending directly above said portal of said flotation device.

* * * * *